US005078897A

United States Patent [19]

McCain

[11] Patent Number: 5,078,897

[45] Date of Patent: Jan. 7, 1992

[54] STABILIZING A SOLVENT MIXTURE OF ETHYLENE CARBONATE AND AN ALKYL DIESTER

[75] Inventor: Dennis D. McCain, Auburn, Wash.

[73] Assignee: The Boeing Company, Seattle, Wash.

[21] Appl. No.: 411,122

[22] Filed: Sep. 22, 1989

[51] Int. Cl.[5] ..... C11D 7/50

[52] U.S. Cl. ..... 252/170; 252/162; 252/364

[58] Field of Search ..... 252/162, 170, 171, 153, 252/DIG. 8, DIG. 9, 364, 70, 67, 68, 69, 71, 73

[56] References Cited

U.S. PATENT DOCUMENTS

| | | | |
|---|---|---|---|
| 2,935,479 | 5/1960 | Oberdorfer, Jr. | 252/170 |
| 3,113,155 | 12/1963 | Sims | 252/170 |
| 3,796,602 | 3/1974 | Briney et al. | 134/38 |
| 4,192,760 | 3/1980 | Jünger et al. | 252/79 |
| 4,199,021 | 4/1980 | Thoma | 165/1 |
| 4,360,442 | 11/1982 | Reedy et al. | 252/70 |
| 4,361,491 | 11/1982 | Truelock | 252/70 |
| 5,007,969 | 4/1991 | Doscher | 134/38 |

*Primary Examiner*—Paul Lieberman
*Assistant Examiner*—A. Beadles-Hay
*Attorney, Agent, or Firm*—John C. Hammar

[57] ABSTRACT

To avoid freezing out of ethylene carbonate from a mixture of the carbonate and at least one alkyl diester, such as ethylene diacetate, the mixture is "well mixed" at an elevated temperature between the melting point of the carbonate and the denaturing point of the mixture for a predetermined time. The product can be cooled to at least about 32° F. (0° C.) without the formation of carbonate crystals.

28 Claims, 1 Drawing Sheet

STABILIZING A SOLVENT MIXTURE OF ETHYLENE CARBONATE AND AN ALKYL DIESTER

REFERENCE O RELATED APPLICATIONS

This invention is related to U.S. Pat. application No. 07/354,529, filed May 19, 1989, which is a continuation-in-part application based upon U.S. Pat. application No. 07/196,903, filed May 20, 1988.

TECHNICAL FIELD

The present invention relates to a method for mixing or preparing a solvent so that a solid component of the mixture that is dissolved in a liquid will remain in solution even at temperatures well below the freezing point of the solid, and more Particularly, relates to a method for stabilizing a mixture of ethylene carbonate and an alkyl diester, such as ethylene diacetate, against separation of the ethylene carbonate.

BACKGROUND OF THE INVENTION

The related applications describe a cleaning solvent for aerospace applications that is essentially nontoxic, nonflammable, and nonvolatile. Preferably being a eutectic mixture of ethylene carbonate and an alkylene diester (particularly ethylene diacetate), this solvent is an effective replacement for methyl ethyl ketone (M.E.K.), a substance that is a powerful cleaning solvent but that is now restricted (or is likely to be restricted) and limited in its use because of toxicity or for environmental concerns.

Mixtures of ethylene carbonate (i.e. carbonate) and an alkyl diester, however, are susceptible of separation of the carbonate through crystallization of the ethylene carbonate upon cooling. Separation changes the characteristics of the solvent, and makes it difficult to handle. The separation can be overcome by preparing the mixture properly with the method of present invention, which stabilizes the mixture even to temperatures as low as at least about 32° F. (0° C.).

SUMMARY OF THE INVENTION

The stability of a mixture of ethylene carbonate and an alkyl diester (particularly ethylene diacetate) can be improved to Protect against the freezing out (crystallization) of the ethylene carbonate upon cooling to about 32° F. (0° C.) or below by well mixing the mixture while maintaining it at an elevated temperature between the melting point of ethylene carbonate and the denaturing temperature of the mixture for a predetermined time.

By "well mixing," we mean the common chemical engineering meaning; namely, that the mixture is essentially completely dispersed to form a uniform composition throughout the entire volume. A "well mixed " solution can be achieved in a plurality of common ways, as will be understood to those of ordinary skill, including mixing the solution in a plug flow reactor for agitating a batch of the solution with mechanical stirring, ultrasound, or the like, or both.

A preferred mixture is a eutectic mixture of ethylene carbonate and etylene diacetate. Such as mixture has about equal volumes of the two compoents. We have found that unless it is stabilized, the mixture will freeze out ethylene carbonate at about 32 F. or slightly below that temperature. I stabilize the mixture, however, by melting the ethylene carbonate, mixing the melt with ethylene diacetate, and stirring the mixture continuously while heating the mixture to between about 95° F. (30° C.) and 175° F. (79.5° C.) for at least about 5 minutes, At 175° F., however, I have noticed discoloration and/or denaturing, so I prefer to keep the solution below this temperature. I believe that 175° F. is the practical upper limit.

While I prefer to both stir and heat the mixture simultaneously, I believe that the same effect an be achieved by doing he sep s sequentially. That is, stirring ned only occur upon reaching he desired, elevated temperature. Uniform heating of the mixture, however, is achieved by mixing the solution throughout, and such mixing is probably bets achieved commercially in a plug flow reactor rather than in a stirred tank.

In its most general form, then, the present invention relates to a method for mixing a solid and a liquid to achieve a stable solution at temperatures below the freezing point of the solid. I input thermal and mechanical energy to the solution after melting the solid and mixing it with the liquid, to promote "well mixing" for a preferred solution of ethylene carbonate and ethylene diacetate (an alkyl dialkylate or an alkyl diester), the stabilization is achieved by mixing the solution at a temperature between the melting point of the carbonate and the denaturing temperature of the solution. I believe that, in this preferred solution, the components associate upon mixing to lock the carbonate with the diacetate through hydrogen bonding and van der Waals forces.

BRIEF DESCRIPTION OF THE DRAWINGS

The drawing is a schematic block diagram of a plug flow reactor usable for the method of the present invention.

BEST MODE CONTEMPLATED OR CARRYING OUT THE INVENTION

Figure 1:
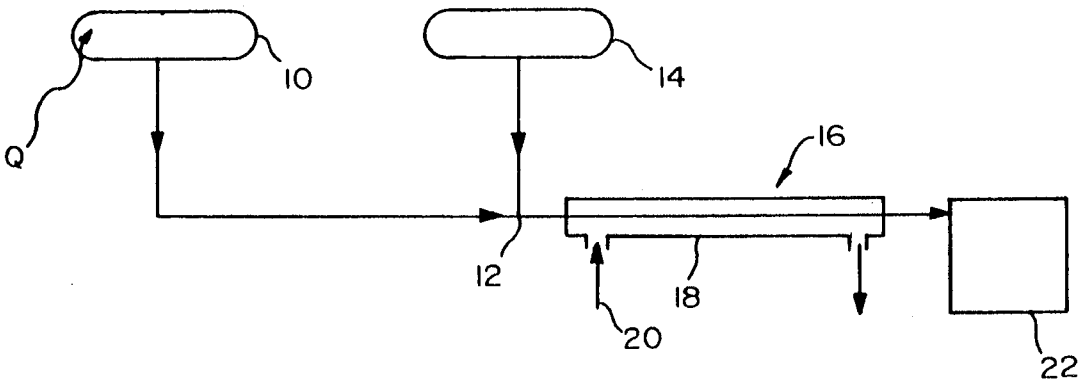

Patrisha Doscher has discovered that a mixture of ethylene carbonate and an alkylene diester, such as ethylene diacetate or ethylene dibutyrate, is an excellent solvent usable in many aerospace applications as a replacement for methyl ethyl ketone (M.E.K.). This solvent is essentially nontoxic, nonvolative, and nonflammable. It can be used with or without additional compounds to clean many residues. A preferred mixture comprises a eutectic mixture of ethylene diacetate and ethylene carbonate (about equal volumes provides the constant boiling mixture). This eutectic mixture is a potent cleaner that is aprotic and non-corrosive, and is particularly attractive for aerospace cleaning of sensitive materials, such as aluminum and its alloys. The solvent is more completely described in the applications identified in the "Reference to Related Applications."

A mixture of ethylene carbonate and ethylene diacetate can separate upon cooling to about 32° F. (0° C.) by freezing out (crystallization of) some of the ethylene carbonate. Such a solution is not practical or readily usable, particularly because it changes the cleaning power of the mixture and poses preparation obstacles for the worker tasked with cleaning (i.e., getting the solid back into solution). If the mixture could be stabilized, it would improve its acceptability in the industry.

Solidification or separation of the ethylene carbonate is a problem because it is difficult to remelt this component to reconstitute the cleaning solvent. The difficulty does not arise from undue melting temperatures, but rather is a practical problem. Bottles, drums, or tanks for carrying liquids are generally not designed for heating to 95° F. (30° C.), the melting Point of ethylene carbonate. Therefore, to reconstitute the mixture, elaborate "double boiler" systems or immersion heaters must be used, and such schemes would make the mixture economically unacceptable. The increased number of preparation steps would also discourage its acceptability.

I have found, however, that a mixture of ethylene carbonate and ethylene diacetate can easily be stabilized against freezing out of the ethylene carbonate by making up and treating the mixture properly at the outset.

Ethylene carbonate (the carbonate) dissolves slowly in ethylene diacetate (the diacetate). Therefore, to promote mixing and dissolution, it is almost always necessary to melt the carbonate prior to addition of the diacetate. Having such heating equipment available makes it relatively easy to use heat (Q) then to treat the mixture to reduce or to eliminate the carbonate freezing problem.

Generally, I prefer to melt the carbonate and to add the diacetate to the melt while continuing heating and stirring of the mixture. A well mixed solution is rapidly formed if I raise the mixture temperature above the melting point of the carbonate (about 95° F. (35° C.)). The mixture temperature, however, should be limited to a range below the denaturing temperature of the mixture. I have observed discoloration occurring in the mixture (which I attribute to denaturing or other chemical reactions) at about 175° F. (79.5° C.), and I recommend against heating the mixture to or above this temperature. I have obtained satisfactory results for batch mixing by heating the mixture to about 138° F. (59° C.) for at least about 5 minutes while stirring the batch with mechanical stirring (i.e., an impeller).

For commercial applications, however, my bench-scale batch method is undoubtedly impractical. Therefore, I propose the "plug flow" system illustrated in the drawing. There, ethylene carbonate is melted in a heated tank 10 and the liquid is pumped or otherwise transferred to a convergence zone 12 where the carbonate is mixed with the diacetate from holding tank 14 in turbulent, "plug flow" conditions. The "plug flow" reactor 16 has a jacket 18, allowing steam 20 to heat the mixture. Conventional thermal controls (not shown) for the steam and pumps for the steam and solvent control the temperature of the mixture within the desired range. A stabilized (well mixed) mixture exits the reactor 16 into holding tank 22 for bottling or other suitable transport.

Alternatively to heating the mixture actively following mixing, the diacetate may be heated to a relatively high temperature so that, upon mixing, the mixture temperature is within the desired temperature range. In this case, the reactor should simply be insulated.

I have not determined which of these continuous mixing schemes might be more energy efficient or commercially practical. Of course, many other treatment schemes could be used. For example, heat and agitation might be applied with ultrasonic transducers, replacing either the heaters or impellers, or both in the schemes described above. Those skilled in the art will understand the vast array of available options to treat the mixture.

While described principally with reference to ethylene diacetate, I believe that the invention has equal applicability to other mixtures of ethylene carbonate and one or more alkyl diesters, particularly ethylene dibutyrate. It apparently is useful for stabilizing all mixtures of ethylene carbonate and ethylene dialkylates, wherein the alkylate is a lower alkylate having about 1-8 carbon atoms. I prefer to use mixtures of ethylene carbonate and ethylene diacetate and/or ethylene dibutyrate.

It may be possible to obtain a well mixed composition of the carbonate and diacetate simply by agitating the mixture, even if the carbonate is in the solid state. I believe, however, that the time to achieve stability would be inordinate. Therefore, I Prefer the method that both mechanically agitates and heats the mixture, taking advantage of both thermal and mechanical energy to achieve the mixing.

Although not wishing to be limited by theory, I believe that the ethylene carbonate and ethylene diacetate associate together with hydrogen bonding and van der Waals forces to form stable complexes of two or more molecules. Once formed, the solution is stable. The carbonate is complexed with the diacetate, and is not free to separate without the input of energy to dissociate the complex. In any event, if mixed in the proper Proportions and well mixed, ethylene carbonate and ethylene diacetate form a eutectic mixture (constant boiling mixture) that is stable against crystallization to at least about 32° F. (0° C.).

While a eutectic mixture has essentially about equal volumes of carbonate and diacetate, the mixture can comprise other proportions, and preferably includes about 5-60 vol % carbonate, and, more preferably, about 40-60 vol. % carbonate.

While preferred embodiments have been shown and described, those skilled in the art will be able to recognize variations, alterations, or modifications of the embodiments that might be made without departing from the inventive concept. Therefore, the claims should be construed liberally in light of this description and drawing to cover adequately all aspects of the invention, and should not be limited to the specific or preferred embodiments unless such limitation is necessary in view of the pertinent prior art.

I claim:

1. A method for stabilizing a solvent mixture of ethylene carbonate and an alkyl diester comprising the step of:

heating the mixture to a temperature above about 95° F. for at least about five minutes while stirring the mixture to eliminate the formation of ethylene carbonate crystals upon cooling the mixture to about 32° F. (0° C.).

2. A method for stabilizing a solvent mixture of the etylene carbonate and an alkyl diester to eliminate the formation of ethylene carbonate crystals upon cooling the mixture to about 32° F. (0° C.) comprising the steps of:

(a) melting ethylene carbonate;

(b) mixing the melted ethylene carbonate with an effective amount of at least one alkylene diester to from a mixture suitable for use as a solvent having about 5-60 vol % etyelen carbonate; and (c) heating the mixture to an elevated temperature not in excess of about 175° F. (79.5° C.) while stirring the mixture to blend the carbonate and diester thereby stabilizing the mixture against formation of crystals went he mixture is cooled below about 32° F. (0° C.).

3. The method of claim 2 wherewith alkyl diester is ethylene diacetate.

4. The method of claim 1 wherein the ethylene carbonate comprises between about 5-60 vol % of the mixture.

5. The method of claim 2 wherein the step of heating includes maintaining the temperature of the mixture between at least the melting point of ethylene carbonate and the denaturing Point of the mixture 6. The method of claim 2 wherein the temperature is about 138° F. (59° C.).

7. The method of claim 2 wherein the step of heating maintains the temperature for at least about 5 min.

8. The method of claim 6 wherein the temperature is at least about 138° F. (59° C.) but is less than the denaturing point of the mixture.

9. The method of claim 8 wherein the temperature is maintained for at least 5 min.

10. A method for stabilizing a solvent mixture of etylene carbonate and an alkylene diester, comprising the steps of:

heating the mixture to a temperature between about 95°-175° F. (35°-79.5° C.), the heating being sufficient to ensure that crystals do not form in the mixture when the mixture is cooled below about 32° F. (0° C.).

11. The method of claim 10 further comprising the step of agitating the mixture to mix the components while heating the mixture.

12. The method of claim 11 wherein agitating includes mechanical stirring.

13. A method for stabilizing a solvent mixture of theylene carbonate and an alkyl diester, comprising the steps of:

blending the mixture for a sufficient time of at least about five minutes to ensure that crystals do not form in the mixture when the mixture is cooled below about 32° F. (0° C.).

14. The method of claim 10 wherein the alkyl diester is ethylene diacetate.

15. The method of claim 14 wherein the ethylene carbonate comprises about 40-60 vol % of the mixture.

16. The method of claim 13 wherein the alkyl diester is ethylene diacetate.

17. The method of claim 16 wherein the ethylene carbonate comprises about 40-60 vol % of the mixture.

18. A method for making stabilized solvent mixture form ethylene carbonate and an alkyl diester comprising he step of:

(a) combining essentially about equal volumes of liquid ethylene carbonate and a liquid alkyl dister to form a mixture;

(b) mixing the mixture; and (c) maintaining the temperature o the mixture between he melting point of ethylene carbonate and the enduring temperature of the mixture, but not in excess of about 175 ° f. (79.5° C.), for a sufficient time of at least about five minutes to stabilize the solvent to ensure that crystals do to form in the mixture when the mixture is cooled below about 32° C. (0° C.).

19. The method of claim 18 wherein the diester is ethylene diacetate.

20. The method of claim 19 wherein the temperature is maintained between about 95° F. (35° C.) and 175° F.

21. The method of claim 23 wherein that temperature is about 138° F. (59° C.).

22. The method of claim 18 wherein steps (a), (b), and (c) occur in a plug flow rector.

23. The method of claim 22 wherein the temperature is maintained by heating the reactor with steam.

24. The method o claim 18 wherein the mixing includes mechanical stirring.

25. The method of claim 18 wherein steps (b) and (c) are done simultaneously.

26. A method of stabilizing a mixture of etylene carbonate and ethylene diacetate, comprising the steps of:

mixing etylene carbonate and ethylene diacetate for at least about five minutes at a temperature in excess for the melting point of ethylene carbonate to stabilize the mixture against formation of crystals went mixture is cooled below about 32° F. (0° C.).

27. The method of claim 26 wherein the mixture comprises about 40-60 vol % ethylene carbonate.

28. A method for stabilizing a solvent mixture of ethylene carbonate and an alkyl diester to eliminate the formation of ethylene carbonate crystals upon cooling the mixture to about 32 ° F. (0° C.), comprising the steps of:

(a) melting methlene carbonate;

(b) mixing the carbonate with eh alkyl dister to form a mixture having about 5-60 vol % carbonate;

(c) heating the mixture to a temperature between the melting point of ethylene carbonate and about 175° F. (79.5° C.) to blend the carbonate and alkyl diester to achieve the stabilization; and (d) optionally, mechanically agitating the mixture while heating the mixture to reduce the time needed to achieve a stabilization.

* * * * *